United States Patent [19]

Massie

[11] 4,335,910

[45] Jun. 22, 1982

[54] DOOR RESTRAINING DEVICE

[76] Inventor: Lewis E. Massie, Box 79, Solana Beach, Calif. 92075

[21] Appl. No.: 11,793

[22] Filed: Feb. 14, 1979

[51] Int. Cl.[3] ..... E05C 17/54

[52] U.S. Cl. ..... 292/259 R

[58] Field of Search ..... 70/417; 292/259, 260, 292/303

[56] References Cited

U.S. PATENT DOCUMENTS

| | | | |
|---|---|---|---|
| 1,593,684 | 7/1926 | Anakin | 70/417 X |
| 3,752,518 | 8/1973 | Cannell | 292/259 X |
| 3,980,330 | 9/1976 | Walker | 292/259 R X |
| 4,042,201 | 8/1977 | O'Callaghan | 292/87 X |
| 4,082,332 | 4/1978 | Palmer | 292/259 R |

*Primary Examiner*—Richard E. Moore

[57] ABSTRACT

A door restraining device comprising a cylindrical bar mounted horizontally across the door. The bar having rotatable sleeves positioned opposite the interface between the door and the door frame. The sleeves positionable to accommodate doors of various widths. The bar is secured by mounting brackets affixed to the door frame on each side of the door. The mounting brackets having an offset inner extremity so as to position the sleeves out of alignment with the door frame and door interface.

2 Claims, 4 Drawing Figures

DOOR RESTRAINING DEVICE

BACKGROUND

Door restraining bars are old in the art but new improvements in methods and materials for defeating the bars demand a corresponding improvement to defend the bars from attack.

Restraining bars mounted horizontally across the inside of the door became vulnerable to saw blades and other cutting tools introduced through the interface between the door and the door frame. The first defense to this method of attack was the introduction of bars made of hardened metals which were difficult to cut with conventional saws and cutting tools. The introduction of saw blades and cutting tools having diamond cutting surfaces obsoleted the hardened metal bar.

SUMMARY

A door restraining device, a bar, which can be easily mounted horizontally across the inside of the door by means of brackets affixed to the door frame. The bar having a circumferential groove near one end which engages a vertical slot on one bracket. The purpose of the latch is to prevent longitudinal movement of the bar.

Rotatably mounted on the bar are two sleeves which are positionable by frictionally biased rubber, or plastic, collars. By sliding the collars they can be used to position the rotatable sleeves opposite the interface between the door and the door frame. Two of the collars having an outside dimension greater than the sleeve are positioned opposite the door face so that pressure between the door and the bar will not restrain the collars from rotating freely.

The offset extremity of the mounting brackets extending away from the door and door frame inside surface contains the aperture for the bar. The offset is directed away from the door and serves to shield the interface of the sleeve and the small diameter collar from attack by a cutting tool introduced through the aperture between the door and the frame.

Therefore, it is an objective of this invention to provide a door restraining bar with freely rotating sleeves positioned opposite to the interface of the door and the door frame to prevent cutting tools from attacking the bar.

Another objective of this invention is to provide a door bar of fixed length that can be adapted to doors of various widths. This is accomplished by providing adjustable collars to position the rotatable sleeves.

A further objective of this invention is the use of large diameter collars opposite the door face to shield the sleeves from pressure between the door and the door bar.

Further objects and advantages of this invention will become apparent from the study of the following portion of these specifications, the claims and the attached drawings.

DESCRIPTION

Figure 1:
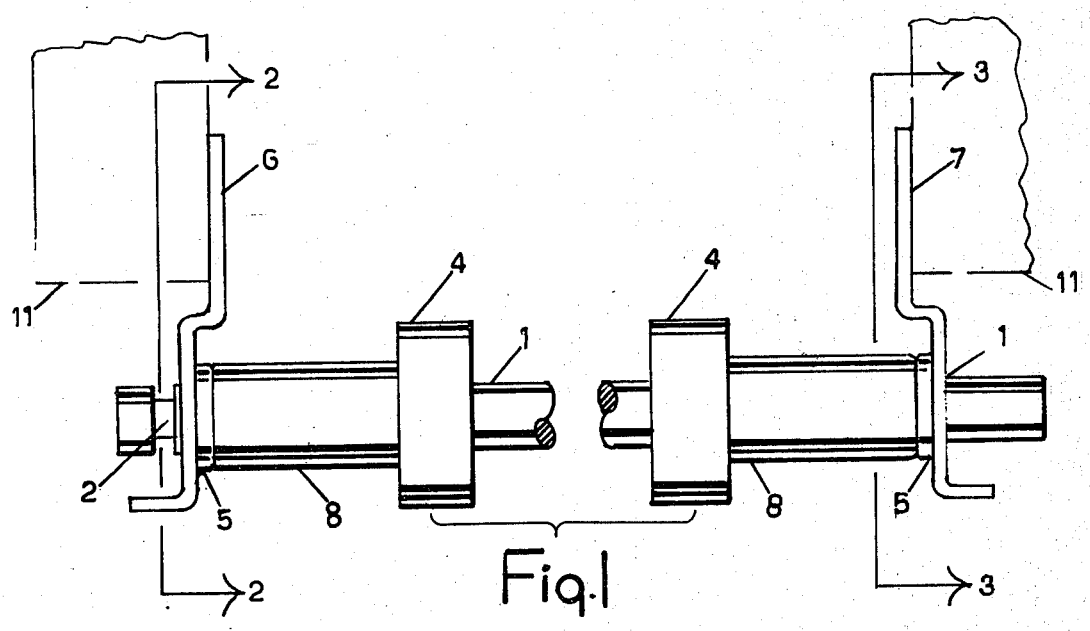
FIG. 1 is a top plan view of the door restraining device.
Figure 2:
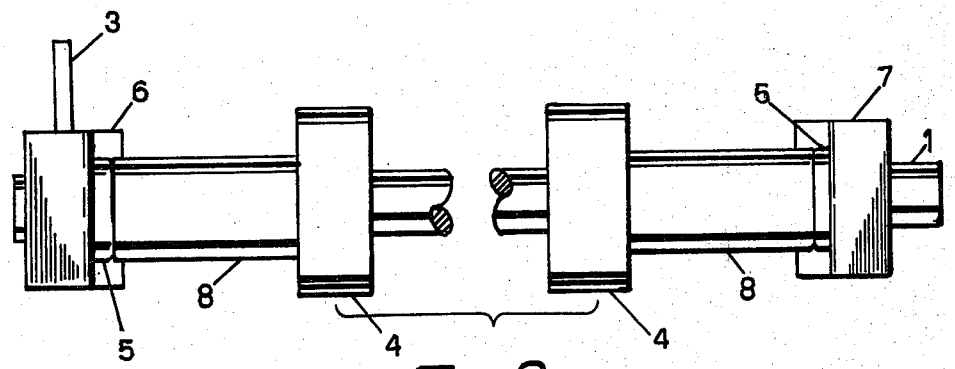
FIG. 2 is a front elevation of FIG. 1.
Figure 3:
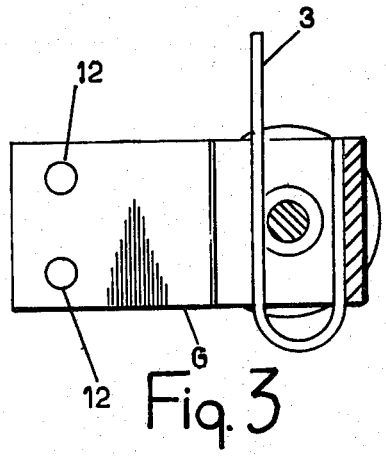
FIG. 3 is a section along the line 2—2 of FIG. 1.
Figure 4:
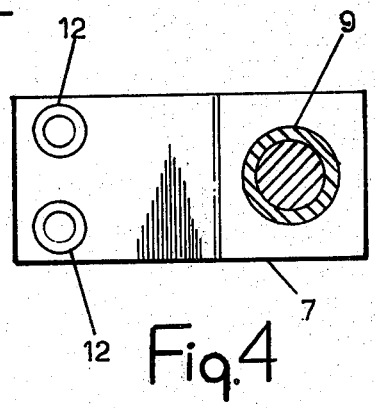
FIG. 4 is a section along the line 3—3 of FIG. 1.

Referring in detail to the drawings and more particularly to FIG. 1, 1 is a cylindrical bar mounted across the door 10 with groove 2 engaging the slot 3 in bracket 6. The sleeves 8 are positioned on bar 1 by means of rubber collars 4 and 5. The collars 4 and 5 are frictionally secured to bar 1. The right end of bar 1 is secured in aperture 9 of bracket 7. Brackets 6 and 7 are affixed to door frame 11 by means of screws through holes 12.

The invention having been described in its preferred embodiment, it is clear that it is susceptible to numerous modifications and embodiments within the ability of those skilled in the art. Accordingly, the scope of this invention is defined by the scope of the following claims.

I claim:

1. A door restraining device to prevent the opening of a door, said device having an elongate rigid bar and a pair of brackets for selectively mounting the bar across the door opening wherein the improvement comprises:

(a) a cylindrical bar having two rotatable sleeves mounted thereon each sleeve positioned opposite the interface of the door and the frame;

(b) said sleeves being adjustably positioned by Collars mounted on the bar at each end of the sleeves; and, (c) means for securing said sleeves to the bar, said positioning collars further comprising:

(d) a first pair of collars having outside diameters greater than the outside diameter of the sleeves; and (e) a second pair of collars having outside diameters equal to or less than the outside dimension of the sleeves.

2. A door restraining device to prevent the opening of a door said device having an elongate rigid bar and a pair of brackets for selectively mounting the bar across the door opening wherein the improvement comprises:

(a) a cylindrical bar having two rotatable sleeves mounted thereon each sleeve positioned opposite the interface of the door and the frame;

(b) said sleeves being adjustably positioned by collars mounted on the bar at each end of the sleeves; and (c) means for securing said sleeves to the bar, (d) said bar being of metal and having a minimum corner radius circumferential groove near one end;

(e) positioning collars made of a reslient material, the inside diameter of said collars being slightly less than the outside diameter of the bar;

(f) a first one of an offset metal mounting bracket having a vertical slotted aperture of a width accomodating the circumferential groove in one end of the bar; and (g) a second one of an offset metal mounting bracket having a circular aperture accomodating the other end of the bar.

* * * * *